US005163007A

United States Patent [19]

Slilaty

[11] Patent Number: 5,163,007

[45] Date of Patent: Nov. 10, 1992

[54] SYSTEM FOR MEASURING CUSTOM GARMENTS

[76] Inventor: Halim Slilaty, 60 Johnson Ave., Binghamton, N.Y. 13905

[21] Appl. No.: 611,582

[22] Filed: Nov. 13, 1990

[51] Int. Cl.[5] ..... G06F 15/46

[52] U.S. Cl. ..... 364/470; 364/562

[58] Field of Search ..... 364/470, 191-193, 364/562, 561; 33/17 R, 17 A

[56] References Cited

U.S. PATENT DOCUMENTS

| | | | |
|---|---|---|---|
| 2,631,374 | 3/1953 | Purdy | 33/2 R |
| 3,902,182 | 8/1975 | Hillborg et al. | 354/105 |
| 4,149,246 | 4/1979 | Goldman | 364/470 |
| 4,546,434 | 12/1985 | Gioello | 364/470 |
| 4,586,150 | 4/1986 | Budziak et al. | 364/562 |
| 4,598,376 | 7/1986 | Burton et al. | 364/470 |
| 4,885,844 | 12/1989 | Chun | 33/15 |
| 4,916,624 | 4/1990 | Collins et al. | 364/470 |

*Primary Examiner*—Joseph Ruggiero
*Attorney, Agent, or Firm*—Salzman & Levy

[57] ABSTRACT

The invention features a method for generating custom clothing dimensions. Data is entered into a computer processor. The data represents a set of measurements defining a subject's body size and shape, the subject's clothing style and preference, and the subject's physical characteristics. The subject's physical characteristics may be interpreted from a photograph of the subject. Final dimensions of the clothing are generated as a function of the entered data. The final dimensions are then displayed. Finally, an evaluation of the final measurements and dimensions can be made, based on the subject's history.

21 Claims, 7 Drawing Sheets

Customer _____ Date _____

_____ Office Phone _____

_____ Zip _____ Home Phone _____

Weight from _____ to _____ Present Weight

Coat size history ____ waist size ____ shirt collar ____ shirt sleeves ____

Coat fitting difficulties _____

Pants fitting difficulties _____

30

MEASUREMENTS

| | | | |
|---|---|---|---|
| 1 Chest | 9 Yoke<br>S<br>C | 15 Out Seam to Floor<br>R _____<br>L _____ | 22 Wrist |
| 2 Overarm | 10 Sleeves<br>R _____<br>L _____ | 16 Front to Floor | 23 Heavy Watch?<br>☐ Left<br>☐ Right |
| 3 Waist | 11 Vest Front | 17 Back to Floor | 24 Insleeve<br>R _____<br>L _____ |
| 4 Stomach | 12 Vest Back | 18 Pants Length<br>R _____<br>L _____ | 25 Incline |
| 5 Seat | 13 Trousers on hips<br>☐ Regular<br>☐ M. Low<br>☐ Low<br>☐ Ext. Low<br>☐ M. High<br>☐ High<br>☐ Extra High | 19 Knee (optional) | 26 Height |
| 6 Thigh | | 20 Bottom (optional) | 27 Heel Height |
| 7 Neck to Thigh | 14 Fit in Crotch<br>☐ Medium<br>☐ Easy<br>☐ Full<br>☐ Trim<br>☐ Close | 21 Leg Posture<br>☐ Regular<br>Bow _____ F<br>Knock _____ F<br>Toes In _____ °<br>Toes Out _____ ° | 28 Neck |
| 8 Neck to Floor | | | 29 Take Pictures |

32

TRY-ON COAT

| | | | |
|---|---|---|---|
| Size (optional) | Model (optional) | Coat Length (optional) | Girth (optional) |
| Insleeves (optional)<br>R _____<br>L _____ | Back (optional) | Point-to-Point (optional) | |

Figure 3a

FIT PREFERRED

| | | | | | |
|---|---|---|---|---|---|
| Coat Shoulders | ☐ Med | ☐ Easy | ☐ Full | ☐ Trim | ☐ Close |
| Coat Girth | ☐ Med | ☐ Easy | ☐ Full | ☐ Trim | ☐ Close |
| Coat Length | ☐ Med | ☐ M. Long | ☐ Long | ☐ M. Short | ☐ Short |
| Coat Sleeves | ☐ Med | ☐ M. Long | ☐ Long | ☐ M. Short | ☐ Short |
| Pants Seat | ☐ Med | ☐ Easy | ☐ Full | ☐ Trim | ☐ Close |
| Pants Length | ☐ Med | ☐ M. Long | ☐ Long | ☐ M. Short | ☐ Short |
| Vest Body | ☐ Med | ☐ Easy | ☐ Full | ☐ Trim | ☐ Close |
| Shirt Body | ☐ Med | ☐ Easy | ☐ Full | ☐ Trim | ☐ Close |
| Shirt Sleeves | ☐ Med | ☐ M. Long | ☐ Long | ☐ M. Short | ☐ Short |

34

STYLING

| Pants Fronts | Legs Style | Pants Bottom | Shirt Cuff |
|---|---|---|---|
| ☐ Plain | ☐ Straight | ☐ Plain | ☐ 1 Button |
| ☐ Pleated | ☐ Tapered | ☐ Cuffed | ☐ 2 Button |
| ☐ Pinch Pleated | ☐ Full Taper | | ☐ 3 Button |
| ☐ Full Pleated | ☐ Ext. Taper | | ☐ French |
| | ☐ Flared | | |
| | ☐ M. Flare | | |
| | ☐ Full Flare | | |

36

Comments:

PHYSICAL CHARACTERISTICS: (Factory Use Only)

Shoulder Slope: ____° L ____° R

L. Arm Length: ____ Even ____° Shorter ____° Longer

Posture: ____ Regular ____ H. Forward ____ Stooped

____ 1/2 Erect ____ Erect

| | | | |
|---|---|---|---|
| CHEST: | ☐ Average | ☐ Full | ☐ Flat |
| SEAT: | ☐ Average | ☐ Prominent | ☐ Flat |
| NECK: | ☐ Average | ☐ Long | ☐ Short |
| ARMS: | ☐ Average | ☐ Forward | ☐ Back |

| | | | | |
|---|---|---|---|---|
| SHOULDERS: | ☐ Average | ☐ Forward | ☐ Back | |
| BICEPS: | ☐ Average | ☐ Large | ☐ Small | |
| BLADES: | ☐ Average | ☐ Prominent | ☐ Narrow | |
| FRONT BAND: | ☐ Average | ☐ Low | ☐ High | |
| ABDOMEN: | ☐ Average | ☐ Large | | |
| HIPS: | ☐ Average | ☐ Heavy | | |
| THIGHS: | ☐ Average | ☐ Large | ☐ Small | |
| SWAY BACK: | ☐ None | ☐ Minor | ☐ Moderate | ☐ Major |
| CALVES: | ☐ Average | ☐ Prominent | | |

38

Figure 3b

FINAL DIMENSIONS

Coat

| | |
|---|---|
| Length: | 29.68 |
| Chest: | 41.50 |
| Overarm: | 48.50 |
| Back: | 9.06 |
| Point to Point: | 18.50 |
| Waist: | 32.09 |
| Seat: | 39.09 |
| Girth: | 19.55 |
| 1/2 Seat: | 20.55 |
| Insleeves: | R 15.88 L 15.63 |

Vest

| | |
|---|---|
| Chest: | 41.50 |
| Waist: | 32.09 |
| Front Length: | 28.22 |
| Opening: | 14.61 |
| Back Length: | 21.50 |
| 1/2 Waist: | 18.00 |

Pants

| | |
|---|---|
| Outseams: | R 40.13 L 40.19 |
| Rise: | 10.31 |
| Inseam: | 29.85 |
| Waist: | 31.00 |
| Seat: | 40.19 |
| Abdomen: | 37.09 |
| Thigh: | 22.25 |
| Knee: | 21.31 |
| Bottom: | 18.06 |

Shirt

| | |
|---|---|
| Collar: | 15.88 |
| Chest: | 41.50 + 4.75 |
| Waist: | 32.00 + 5.19 |
| Hips: | 37.09 + 5.19 |
| Waist Length: | 18.25 |
| Tail Length: | 29.77 |
| Yoke: | 19.00 |
| Sleeves: | R 33.00 L 32.75 |
| Cuff Length: | R 9.50 L 9.50 |

90

PHYSICAL CHARACTERISTICS

| | |
|---|---|
| Shoulder Slope: | L 2 R 2.25 |
| Posture: | regular |
| Incline: | 2.5 |

38a

COMPARISON DIMENSIONS

| | | | |
|---|---|---|---|
| Insleeve: | R 16.25 | Shoulder Low? | R .25 L |
| Pants Length: | 40.25 | Coat Length (Opt.): | |
| Knee (Opt.): | | Coat Girth (Opt.): | |
| Bottom (Opt.): | | | |

92

Figure 5

SYSTEM FOR MEASURING CUSTOM GARMENTS

BACKGROUND OF THE INVENTION

The present invention relates to a method and apparatus for generating custom clothing and, more particularly, for measuring custom suit and shirt dimensions substantially independent of the person who obtains the subject's measurements.

In the field of custom tailoring and clothing generating, consistency has been notably absent because no two tailors obtain the same measurements of a subject or wearer for all parts of a garment. A great number of measurements must be taken of the wearer, and a great deal of subjectivity and complexity is required to arrive at final clothing dimensions. Many measurements are very subjective as to the manner in which they are taken. For example, how tight the tape is held, the exact place to take the measurements, and other measuring factors are different for every tailor. As a consequence of the different procedures, final results vary widely from fitter to fitter to the extent that it is extremely unlikely that any two fitters will have the same result.

Then, the measurements themselves have to be interpreted, usually by the person taking the measurements. This interpretation is necessary because clothing manufacturers do not use the measurements themselves to define the particular shape and fit of the suit. Clothing manufacturers require specific garment dimensions such as coat length, back width, breast size, trouser length, outseam and inseam, and knee dimension. It is these dimensions then, and not the measurements themselves, that determine the actual shape of the suit in the selected style. Therefore, although the set of specific garment dimensions required are quite standard throughout the clothing industry, it is the person measuring the customer who has to translate or interpret the many measurements subjectively into as many as 35 or more dimensions in order to specify the actual shape and fit of the suit or shirt. Accordingly, the garment is often produced more on the basis of the preference of the measurer rather than on that of the customer.

It can therefore be appreciated that, although the measuring of a customer's body and the interpretation of the measurements to derive the actual garment dimensions are the most critical steps in producing a suit, the techniques have remained an art that is difficult to learn. Even after it is learned, it is not a very exacting business. Even though most men desire their suits to fit in an individual, particular fashion, there lacks a standardized method of measuring and dimensioning a suit or shirt which would be acceptable to the customer, but largely independent of the person taking the measurements.

Specifically, since the fitting and making of a custom suit of men's clothing has been an art it can be performed well by only a small number of highly trained tailors or fitters. The average sales person in a clothing store simply does not have the training, background and/or aptitude necessary to accomplish the task. Those most highly skilled technically in this field are, unfortunately, the worst sales people. Conversely, the best sales people are often technically semi-skilled, at best. Simplifying the process of measuring and reducing the requirement for technical skill would result in more garments being sold by competent sales people.

Heretofore, some of the earliest techniques for designing or generating clothing have used photography.

For example, U.S. Pat. No. 2,631,374 issued to Purdy teaches the use of a cylindrical carrier with a series of pattern-profiles mounted upon its perimeter. The perimeter is permeable by light. A slide projector within the hub of the carrier projects an image from a photograph upon the perimeter. The image is brought into register with a profile that represents the clothing pattern of the person photographed.

In U.S. Pat. No. 3,902,182 issued to Hillborg, a person is measured by means of photographs. The person is placed between a camera and a screen provided with grids. The division of the screen is marked in values of unit lengths to represent the photograph values of units shown by the photographed image.

U.S. Pat. No. 4,149,246 issued to Goldman discloses a numerically-controlled cutting apparatus for garments. The system requires the use of a cutting table apparatus and a memory for a substantial number of patterns. In operation, the operator selects a garment pattern from storage. Personal physical data is also supplied. The two forms of data are then combined to formulate the basis for optional variations. The combined data are manipulated by the system to provide specific pattern data, which is processed to control the cutting table apparatus to provide components which are sewn together, resulting in the designed garment.

U.S. Pat. No. 4,598,376 issued to Burton et al also discloses a system for revising or customizing standard patterns. In this system, a subject's measurements are taken and transmitted to a computer. The customer measurements are transmitted to a remote location for manufacture.

U.S. Pat. No. 4,586,150 issued to Budziak et al discloses a hand held device for taking measurements. The measurements are transmitted by an FM transmitter to a separate receiver and storage unit. The storage unit comprises a personal computer with a display that can prompt the user into taking the measurements in a predetermined sequence. An electronic measuring tape takes length measurement. As the user unwinds the tape, an analog output is generated proportional to the length of the tape unwound. A button on the side of the tape causes the output to be converted into a communications signal for transmission to the receiver.

U.S. Pat. No. 4,885,844 issued to Chun teaches the use of a body covering having measurement tapes which are worn by a person undergoing body measurement. The body dimensions of the person being measured are then inspected by a video camera and a computer capable of transmitting measurement data electronically to a remote location. These body dimensions are then utilized for adjustment of an adjustable mannequin to the exact body dimensions of the person being measured. Thereafter, clothing is tailored to the mannequin and can then be delivered to the person.

It would therefore be advantageous to provide the clothing industry with a method of measuring, interpreting the measurements, and making a shirt or suit of clothing wherein the suit would have substantially the same fit and feel, without regard to the person who measured the customer and dimensioned the actual garment pieces.

It would be advantageous to provide a system that would allow those with less than optimum skills to take measurements and have custom made garments produced therefrom. In other words, it would be advantageous to make a shirt or suit on the basis of a smaller number of measurements, and simpler standardized observations than has been possible heretofore, and without highly trained interpretations.

It would be advantageous to provide a system for generating custom clothing dimensions in which data is entered into a computer processor.

It would also be advantageous to provide a method of making the shirt or suit on the basis of a small number of measurements and observations, with the interpretation of the information being performed by a computer processor.

It would also be advantageous to provide such a system in which the data that is entered into a computer processor includes a set of measurements defining a subject's body size and shape, his clothing style and preference, and his physical characteristics.

It would also be advantageous to provide a system for generating custom clothing dimensions in which final clothing dimensions are displayed to an operator.

It would also be advantageous to provide a system for generating custom clothing dimensions in which photographic information is entered into a computer processor.

It would also be advantageous to provide a system for generating custom clothing dimensions in which an evaluation of final measurements and dimensions can be performed as a function of the customer's history.

SUMMARY OF THE INVENTION

In accordance with the present invention, there is provided a method for generating custom clothing dimensions. Data is entered into a computer processor. The data represents a set of measurements defining a subject's body size and shape, the subject's clothing style and preference, and the subject's physical characteristics. The subject's physical characteristics may be interpreted from a photograph of the subject. Final dimensions of the clothing are generated as a function of the entered data. The final dimensions are then displayed. Finally, an evaluation of the final measurements and dimensions can be made, based on the subject's history.

The inventive method exploits the discovery that simplifying the measurement operations will improve the overall final design. Moreover, one need not attain the level of a master tailor to produce measurements or, more importantly, the final garment. One with more limited skills can now acquire the required data and enter such data into a computer. For example, although certain measurements such as girth are extremely difficult to obtain consistently, the invention allows for a girth measurement to be derived from other, more easily obtained measurements. The method of the present invention allows a person with less training than heretofore required to take the measurements, in less time, and with less subjectivity and possibility of error.

BRIEF DESCRIPTION OF THE DRAWINGS

A complete understanding of the present invention may be obtained by reference to the accompanying drawings, when taken in conjunction with the detailed description thereof and in which:

FIGS. 3*a* and 3*b* constitute a computer listing of data input to the computer processor shown in FIG. 1;

FIG. 5 is a computer printout of final garment dimensions generated by the computer processor and printed by the printer/plotter shown in FIG. 1.

DESCRIPTION OF THE PREFERRED EMBODIMENT

Figure 1:
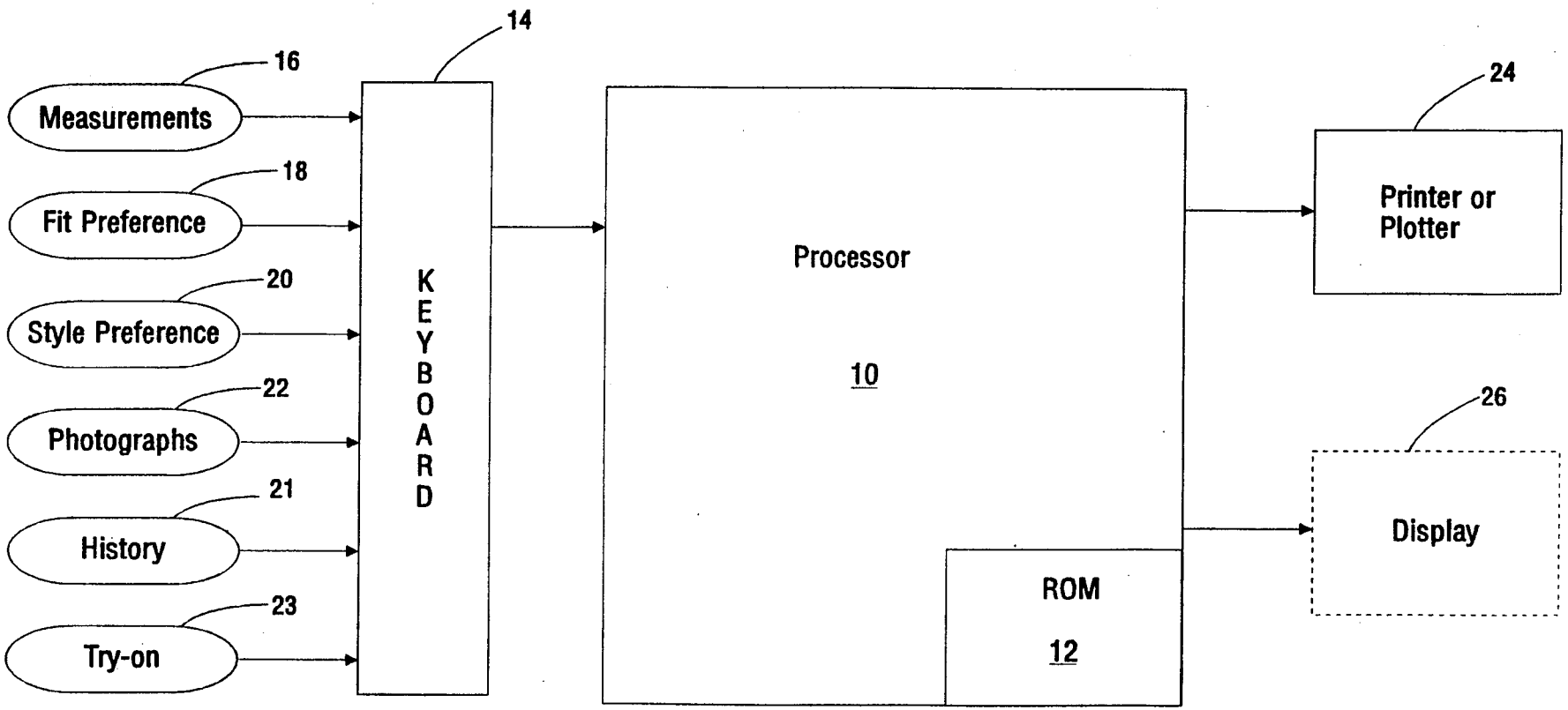
FIG. 1 is a block diagram of the computer system used with the present invention.

Referring now to FIG. 1, there is shown a block diagram of the computer system of the present invention. In the preferred embodiment, an 8-bit microprocessor, such as an IBM PC/XT computer 10, includes read only memory (ROM) 12. A keyboard 14 is connected to microprocessor 10 for providing data thereto. The data that is input via keyboard 14 represents measurements of a client 16 taken by a tailor, fitting preferences 18, if any, as requested by the subject or customer, style preferences 20, if any, specified by the customer, a history of the customer's clothing sizes 21, data from photographs 22 of the customer, and dimensions acquired by so-called "try on" garments 23.

Also connected to microprocessor 10 is a printer or plotter 24, such as an Okidata Microline printer Model No. μ82A. Optionally, a visual display 22 may be connected to microprocessor 10 for displaying information.

Figure 2:
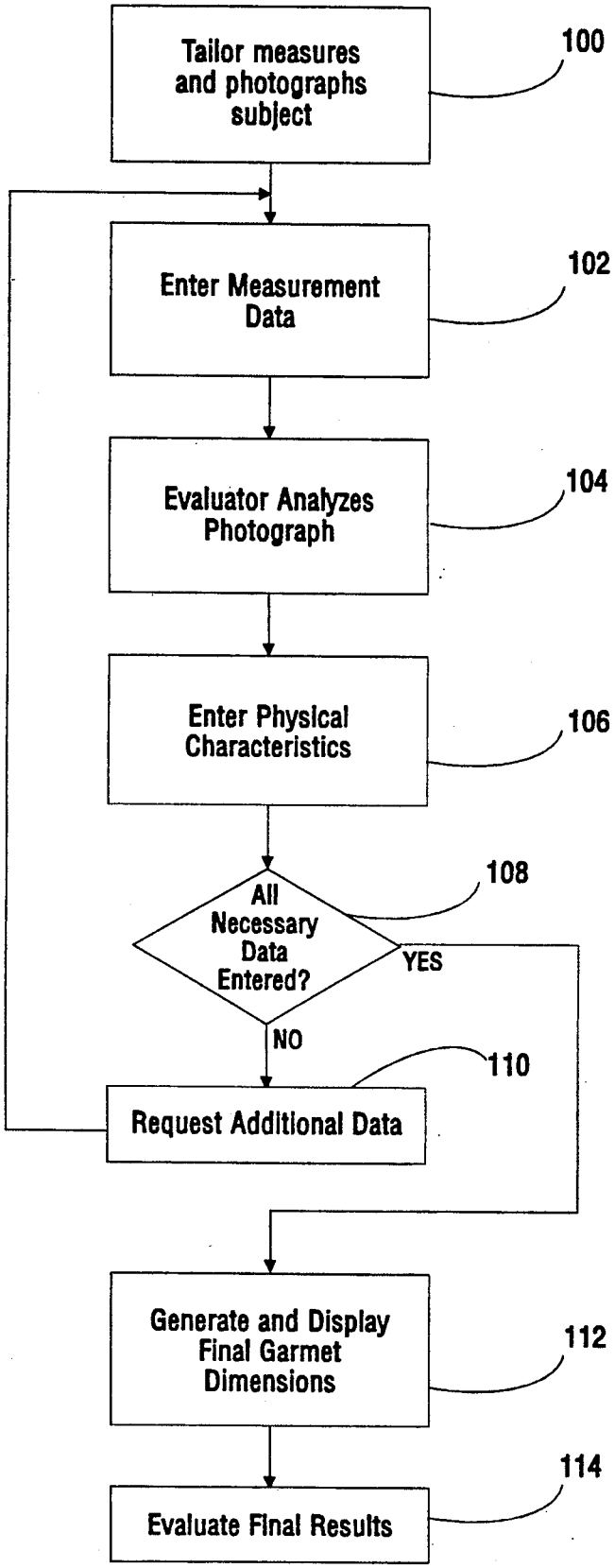
FIG. 2 is a flow chart of the inventive method used to obtain the dimensions of the garment.

Referring now also to FIG. 2, there is shown a flow chart of the inventive method used to obtain the dimensions of the final garment. The tailor, salesperson or fitter measures the subject to provide measurements relating to chest, waist, seat and the like, as shown in greater detail in FIG. 3, below. Once the measurements are taken, one or more photographs of the subject are also taken, step 100. The information provided in writing and by photograph is then submitted to the computer operator, who enters this data, step 102 into microprocessor 10 (FIG. 1), via keyboard 14. The data that is taken and entered includes the subject's clothing size history, actual "try on" garment dimensions, and the subject's actual personal measurements. In addition, such items as the subject's weight, name and the like are also included in the entered measurement data.

A trained evaluator then analyzes the photograph(s), step 104, and enters physical characteristics options, step 106, relating to each of the predetermined physical characteristics called for by the operating program. The system then determines whether all necessary data has been entered into microprocessor 10, step 108. If additional information is required by the program, step 110, additional data is requested and control returns to step 102. If, however, all necessary information has been entered into microprocessor 10, step 108, the computer program generates and displays the final garment dimensions, step 112, based on the entered data.

Finally, the garment dimension results are evaluated by a trained evaluator, step 114, to determine whether the calculated garment dimensions are consistent with other entered data, such as dimensions taken from a "try on" garment, the subject's preferred fit, the subject's styling preference and the subject's clothing history.

Once the final results are determined and approved by the evaluator, step 114, the dimensions may be displayed, printed or otherwise conveyed to the manufacturer from which the actual garment may be cut and manufactured.

Referring now also to FIG. 3, there is shown an order form as used with the invention. Personal information such as customer name, address, phone number, a recent history of sizes and weight, and unique characteristics, if any, are shown generally as reference numeral 30. Detailed measurements, including chest, waist, seat, yoke and the like, as well as actual "try on" garment dimensions, are provided by the tailor and represented by reference numeral 32 in the FIGURE. The fitting preferences of the customer are indicated as reference numeral 34. Styling preferences of the customer are indicated by reference numeral 36. Finally, physical characteristics such as shoulder slope, posture, arms position, abdomen and the like are indicated by reference numeral 38, and are provided by a trained evaluator from photographs, as hereinbelow described.

Figure 4A:
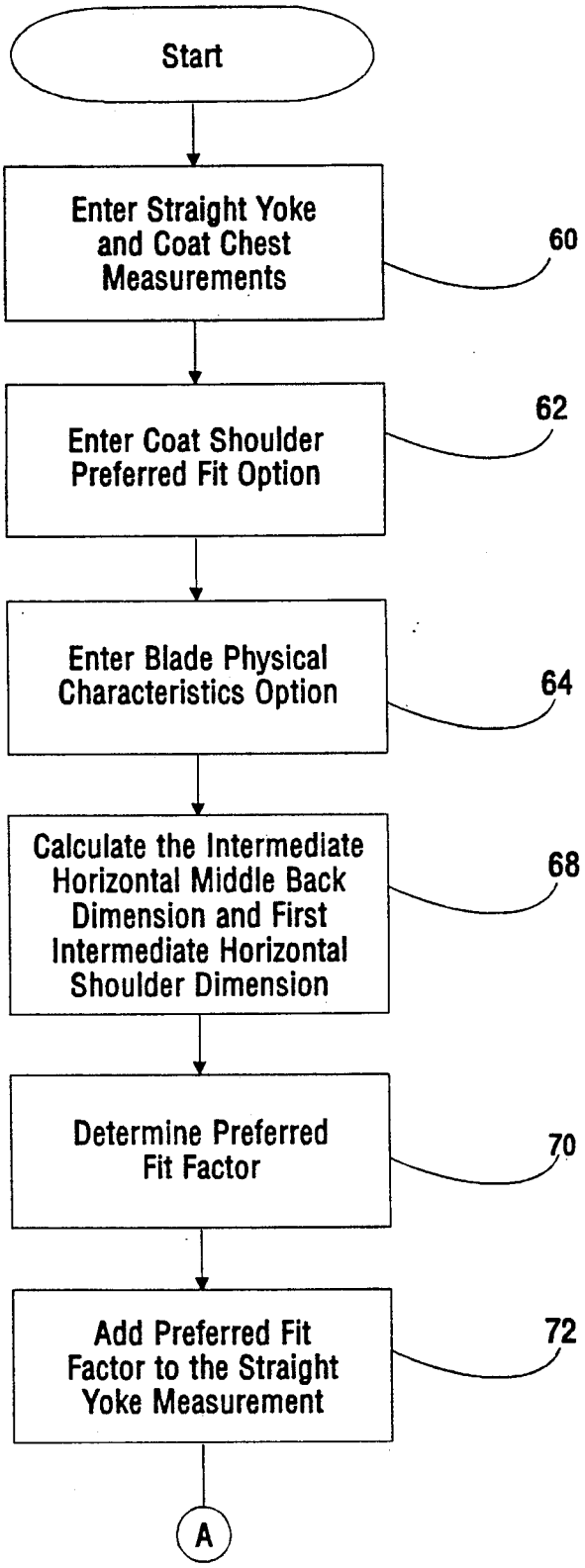
FIGS. 4*a* and 4*b* depict a flow chart of one aspect of the inventive method used to obtain the final back dimensions of the garment.
Figure 4B:
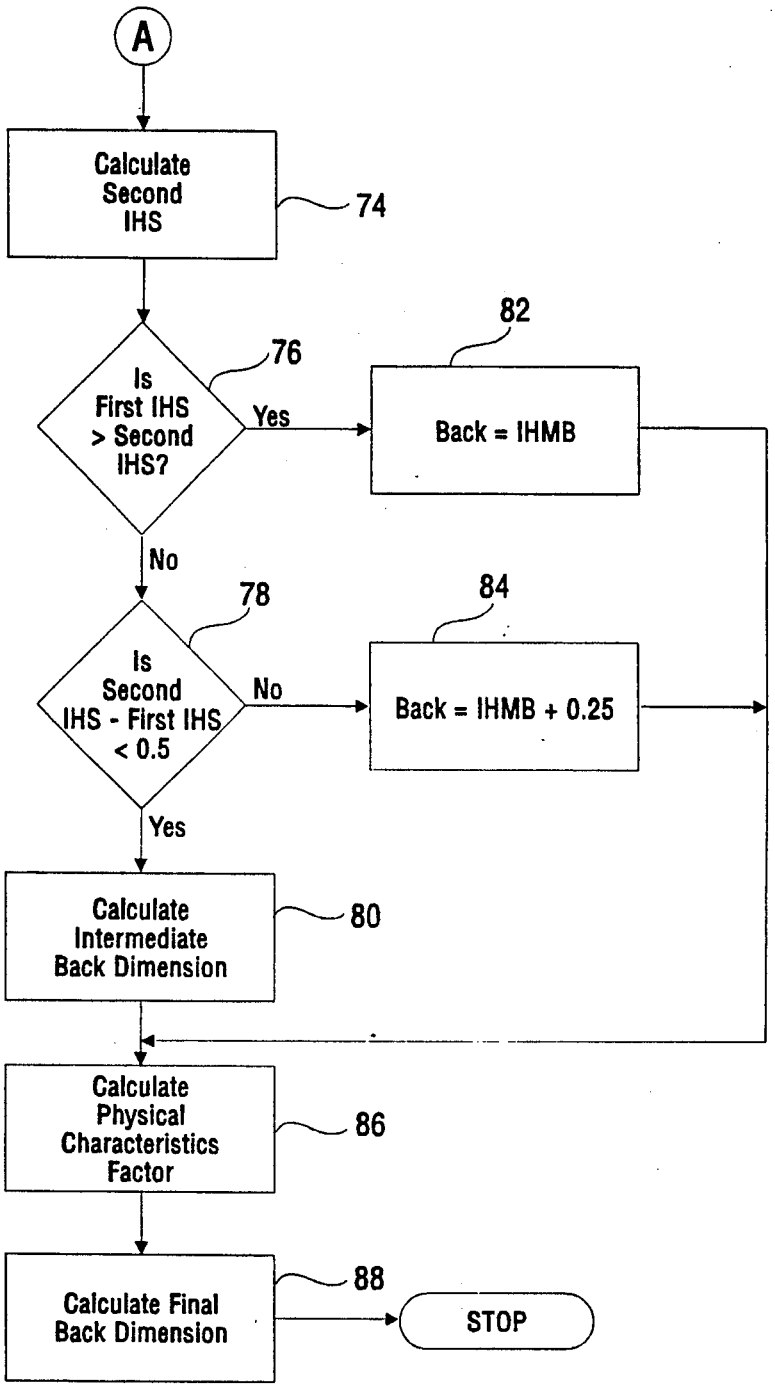

Referring now also to FIGS. 4*a* and 4*b*, there is shown a flow chart described one aspect of the inventive method used to obtain the final dimensions of the garment. The procedure shown in the flow chart indicates how a back dimension for a garment such as a men's jacket is computed. Once microprocessor 10 (FIG. 1) is initialized, a yoke measurement is provided, step 60, by means of keyboard 14. A coat chest measurement is also transferred into this program. The coat chest measurement was previously calculated by one of the other programs, not shown. The coat shoulder preferred fit option (e.g., close, trim, medium, easy, or full) is then provided to microprocessor 10, step 62.

The blade physical characteristic (e.g., narrow, average, or prominent) is then entered, as interpreted from a photograph, not shown, step 64.

An intermediate horizontal middle back (IHMB) dimension is calculated, step 68, in accordance with Equation (1), below.

$$IHMB = 7.75 + (CCM - 32)*0.125 \quad \text{(Eq.1)}$$

where IHMB is the intermediate horizontal middle back dimension; and

CCM is the coat chest measurement.

A first intermediate horizontal shoulder (IHS) dimension value is also calculated, step 68, in accordance with Equation (2), below.

$$IHS = 16 + (CCM - 32)*0.25 \quad \text{(Eq. 2)}$$

where IHS is the first intermediate horizontal shoulder dimension; and

CCM is the coat chest measurement.

A preferred fit factor is then selected from look-up Table I, step 70, based on the preferred fit option entered in step 62.

TABLE I

| Option | Factor |
|---|---|
| Close | −0.25 |
| Trim | −0.25 |
| Medium | 0 |
| Easy | +0.25 |
| Full | +0.25 |

The preferred fit factor is then added to the straight yoke measurement entered in step 60, to result in an intermediate coat yoke value, step 72.

A second intermediate horizontal shoulder dimension value is then calculated by subtracting a factor of 0.25 from the intermediate coat yoke value, step 74.

At this point, the system determines whether the first intermediate horizontal shoulder dimension value, as determined in step 68, is greater than the second intermediate horizontal shoulder dimension value (calculated at step 74), step 76. If not, the system then determines whether the second intermediate horizontal shoulder dimension value is within 0.5 of the first intermediate horizontal shoulder dimension value, step 78. If so, the intermediate back dimension is calculated, step 80, by the formula shown as Equation (3), below.

$$\text{BACK} = IHMB + \frac{(\text{Second } IHS - \text{First } IHS)}{2}$$

where BACK is the intermediate back dimension;

Second IHS and First IHS are the second and first intermediate horizontal shoulder dimension values, respectively.

If, however, the first IHS dimension value is greater than the second IHS dimension value, step 76, the intermediate back dimension is equal to the intermediate horizontal middle back dimension, step 82. Control then continues after step 80 in the flow chart. Similarly, if the difference between the second IHS dimension value and the first IHS dimension value is greater than or equal to 0.5, the intermediate back dimension is set at the intermediate horizontal middle back dimension plus a factor of 0.25, step 84, and control continues after step 80 in the flow chart.

A physical characteristics factor is then selected from look-up Table II, step 86, based on the blade physical characteristics option entered in step 64.

TABLE II

| Option | Factor |
|---|---|
| Narrow | −0.25 |
| Average | 0 |
| Prominent | +0.25 |

In general the physical characteristics option is selected by a trained evaluator from one or more photographs of the subject. The evaluator compares the subject's characteristics (e.g., shoulder blades, biceps, neck length, etc.) to an average or normal characteristic to determine how the actual subject varies from the normal standard for the particular physical characteristic under consideration.

Finally, the final back dimension is calculated as the sum of the intermediate back dimension and the physical characteristics factor, step 88.

Referring now also to FIG. 5, there is shown a computer printout of the final garment measurements. The coat, pants, vest and shirt dimensions are indicated as reference numeral 90. Physical characteristics entered previously, but not considered average, are indicated as reference numeral 38*a*. Finally, the actual "try on" garment dimensions, reference numeral 92, are compared to the calculated final garment dimensions by the evaluator.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

What is claimed is:

1. A method for generating custom clothing dimensions, the steps comprising:

a) entering data into a computer processor, said data being representative of:

i) a set of measurements defining a subject's body size and shape,
ii) said subject's clothing style and preference, and
iii) said subject's physical characteristics;

b) generating final dimensions of clothing as a function of said entered data; and c) comparing said final dimensions with a portion of the entered data of step (a) to determine whether said generated final dimensions of clothing is consistent therewith.

2. The method for generating custom clothing dimensions in accordance with claim 1, wherein said subject's physical characteristics are interpreted from a photographic record thereof.

3. The method for generating custom clothing dimensions in accordance with claim 1, wherein said step (a) further comprises entering into said computer processor data representative of:

iv) said subject's history.

4. The method for generating custom clothing dimensions in accordance with claim 3, wherein said subject's physical characteristics are interpreted from a photograph thereof.

5. The method for generating custom clothing dimensions in accordance with claim 4, the steps further comprising:

d) performing an evaluation of said final dimensions as a function of said data representative of said subject's history.

6. The method for generating custom clothing dimensions in accordance with claim 5, the steps further comprising:

e) storing data representative of said final dimensions.

7. The method for generating custom clothing dimensions in accordance with claim 6, the steps further comprising:

f) storing data representative of said entered data.

8. The method for generating custom clothing dimensions in accordance with claim 1, further comprising the step of:

d) displaying said generated final dimensions.

9. The method for generating custom clothing dimensions in accordance with claim 8, wherein said displaying step comprises printing or plotting said final dimensions.

10. The method for generating custom clothing dimensions in accordance with claim 8, wherein said displaying step comprises displaying said final dimensions on a computer screen.

11. A method for generating custom clothing dimensions, the steps comprising:

a) entering data into a computer processor, said data being representative of:
i) a set of measurements defining a subject's body size and shape, including try-on dimensions,
ii) said subject's clothing style and preference, and
iii) said subject's physical characteristics;

b) generating final dimensions of clothing as a function of said entered data; and c) comparing said final dimensions with known try-on dimensions to determine whether said generated final dimensions of clothing is consistent therewith.

12. The method for generating custom clothing dimensions in accordance with claim 11, wherein said subject's physical characteristics are interpreted from a photographic record thereof.

13. The method for generating custom clothing dimensions in accordance with claim 11, wherein said step (a) further comprises entering into said computer processor data representative of:

iv) said subject's history.

14. The method for generating custom clothing dimensions in accordance with claim 13, wherein said subject's physical characteristics are interpreted from a photograph thereof.

15. The method for generating custom clothing dimensions in accordance with claim 14, the steps further comprising:

d) performing an evaluation of said final dimensions as a function of said data representative of said subject's history.

16. The method for generating custom clothing dimensions in accordance with claim 15, the steps further comprising:

e) storing data representative of said final dimensions.

17. The method for generating custom clothing dimensions in accordance with claim 16, the steps further comprising:

f) storing data representative of said entered data.

18. The method for generating custom clothing dimensions in accordance with claim 11, further comprising the step of:

d) displaying said generated final dimensions.

19. The method for generating custom clothing dimensions in accordance with claim 18, wherein said displaying step comprises printing or plotting said final dimensions.

20. The method for generating custom clothing dimensions in accordance with claim 18, wherein said displaying step comprises displaying said final dimensions on a computer screen.

21. A method for generating custom clothing dimensions, the steps comprising:

a) entering data into a computer processor, said data being representative of:
i) a set of measurements defining a subject's body size and shape,
ii) said subject's clothing style and preference, and
iii) said subject's physical characteristics;

b) calculating a first and second back dimension;

c) comparing said first and second back dimension;

d) based upon a comparison of step (c), obtaining a physical characteristics factor from a look-up table; and e) generating final dimensions of clothing as a function of said first and second back dimension and said physical characteristics factor.

* * * * *